US006763694B1

(12) United States Patent
Boulton et al.

(10) Patent No.: US 6,763,694 B1
(45) Date of Patent: Jul. 20, 2004

(54) VIBRATION DAMPING APPARATUS

(75) Inventors: Gary Boulton, Newcastle (AU); John Edwards, Newcastle (AU); Paul Meehan, Brisbane (AU); Glen Wallace, Pittsburgh, PA (US)

(73) Assignee: Industrial Automation Services PTY LTD, Teralba (AU)

( * ) Notice: Subject to any disclaimer, the term of this patent is extended or adjusted under 35 U.S.C. 154(b) by 0 days.

(21) Appl. No.: 10/019,511

(22) PCT Filed: May 12, 2000

(86) PCT No.: PCT/AU00/00445

§ 371 (c)(1),
(2), (4) Date: Mar. 29, 2002

(87) PCT Pub. No.: WO01/00346

PCT Pub. Date: Jan. 4, 2001

(30) Foreign Application Priority Data

Jun. 25, 1999 (AU) ..... PQ1209

(51) Int. Cl.[7] ..... B21B 31/07

(52) U.S. Cl. ..... 72/245; 72/10.4; 72/246; 72/466.7; 72/466.8

(58) Field of Search ..... 72/10.1, 10.4, 72/237, 245, 466.7, 466.8, 466.9, 246

(56) References Cited

U.S. PATENT DOCUMENTS

| | | | | | |
|---|---|---|---|---|---|
| 3,759,078 A | | 9/1973 | Rotter | | |
| 3,864,955 A | * | 2/1975 | Eibe | | 72/238 |
| 4,920,778 A | * | 5/1990 | Svagr et al. | | 72/237 |
| 5,040,569 A | * | 8/1991 | Nogami et al. | | 137/625.65 |
| 5,343,649 A | | 9/1994 | Petrovich | | |
| 5,724,846 A | | 3/1998 | Wang et al. | | |
| 5,730,692 A | | 3/1998 | Grabscheid | | |

FOREIGN PATENT DOCUMENTS

| | | | | |
|---|---|---|---|---|
| DE | 42 15 402 A1 | | 11/1993 | |
| DE | 42 32 920 A1 | | 3/1994 | |
| JP | 57-44406 | * | 3/1982 | 72/245 |
| JP | 08010807 | | 1/1996 | |
| JP | 8247211 | | 9/1996 | |
| JP | 9-174122 | * | 7/1997 | 72/245 |
| JP | 10-314816 | * | 12/1998 | 72/245 |

* cited by examiner

*Primary Examiner*—Ed Tolan
(74) *Attorney, Agent, or Firm*—Timothy J. Keefer; Seyfarth Shaw LLP

(57) ABSTRACT

Vibration damping apparatus (40) includes a body in the form of backup roll balance piston (42) positionable for sliding movement in an enclosure in the form of cavity (44) in the lower backup roll chock (30) of the mill stack (10). The body of the piston is a casing which performs the role of a conventional postion. A damping means is integral with the piston (42) for providing vibration damping of opposing backup roll chocks (24, 30). The damping means is a specially designed absorption system to provide tuned stiffness and damping elements which act in parallel and are located in compartment (46) at an uppermost end or cap of the piston (42). A second vibration absorbent compartment portion (56) of the piston (42) also includes vibration absorbing components. Portion (56) is an integral cap located at the end of the piston (42) in contact with the fluid (52).

31 Claims, 3 Drawing Sheets

VIBRATION DAMPING APPARATUS

CROSS REFERENCE TO RELATED APPLICATION

This application claims the priority of International Appln. No. PCT/AU00/00445 with an International Filing Date of May 12, 2000.

FIELD OF THE INVENTION

The present invention relates to vibration damping and has been developed primarily, though not exclusively for the suppression or damping of vibration occurring during a metal rolling process. However, it is to be appreciated that the invention has broader suitability in other applications where it is necessary or desirable to damp or suppress vibration.

BACKGROUND ART

Typically strip or sheet metal is rolled to the required thickness by passing the strip between two adjacent rolls which provide the necessary amount of compressive work on both faces of the strip. Generally the principal work rolls are supported in a roll stack by a bearing support means or chocks. The backup roll chocks support backup rolls which contact the respective work rolls in use. A series of pistons are commonly used to apply forces to components of the roll stack, and are typically although not exclusively located in three places:

between the work roll chock and backup roll chock;

between the work roll chocks, and between the backup roll chocks themselves, these usually being the biggest pistons in the roll stack.

Normally the entire roll stack is supported within a mill frame. Such an adjustable roll support system allows the gauge or thickness of the rolled product to be changed at will by adjusting the vertical position of the chocks and their associated rolls.

Advances in technology have allowed rolling mills to operate at relatively high speeds to increase productivity and efficiency, however the occurrence of mechanical vibrations, generally referred to as chatter in the rolling context, has consequently become more prevalent. Chatter involves roll vibration in a substantially vertical direction in generally large uncontrollable amplitudes of motion at a fundamental frequency. Chatter generally, causes periodic, transverse, bands of light and dark appearance across the rolled strip. In some cases, a matching thickness variation of the rolled strip is associated with the "chatter bands". Both the banded appearance and the thickness variation are highly undesirable. Not only must the affected product be rejected, but can also result in breakages of the strip during rolling, leading to damage of the mill equipment. Usually it has been found that as mill speeds are increased the vibrations become more severe. Thus, at present, the only reliable remedy for chatter is to reduce the operating speed of the rolling mill which in turn adversely affects mill productivity.

Generally, three distinct types of mill chatter have been identified, namely:

(i) Torsional chatter, which typically occurs in the 5–25 Hz range and causes significant chatter bands across the strip and small thickness fluctuations. This is often referred to as rumble or shudder, reflecting the low frequency range in relation to the audible range of frequencies. The small variations in thickness may cause fluctuations in surface reflectivity which are aesthetically unacceptable;

(ii) Third octave mode chatter, which typically lies in the 125–240 Hz range and produces large thickness variations and strip rupture. It is characterised by a sudden occurrence (usually <5 seconds) and thus appears to be "self-excited" as opposed to externally excited;

(iii) Fifth octave mode chatter, which typically occurs in the range 500–800 Hz and results in transverse banding of the backup and work rolls and matching transverse surface marking of the strip. To cure the problem, an unscheduled backup roll change is often required. There is experimental evidence to suggest that although there is negligible thickness variation, the strip is not flat and has a periodic corrugated waveform. These strip marks (or corrugations) are still visible after the strip has been temper rolled and painted.

Of the three types of chatter vibration, third octave mode chatter is the most destructive and has the most detrimental effects on mill productivity due to the lower rolling speeds required to avoid the phenomena. However fifth octave chatter seems to be more prevalent in rolling mills and is of increasing concern as customers are demanding better surface quality. For each of these types of chatter there is some form of vibration inherent in the roll stack which is associated with the strip chatter marks.

There have been previous attempts to suppress chatter without resorting to decreasing mill speed. Inflatable housing or frame liners have been proposed which increase friction between the chocks and the mill housing or frame in order to inhibit vertical vibrations of the chocks and their associated rolls in the event of chatter. This approach increases friction between the frame and the mill stack and hysteresis may in fact degrade thickness control performance on the mill.

Various other forms of physical vibration damping apparatus are known in the prior art. In SU488635, pairs of co-axial and opposing hydraulic plunger type cylinders are located between the work roll chocks to provide outward thrust to the work rolls in use, to thereby decrease roll overloads when metal strips enter/exit the stands. The end faces of the cylinders contact one another and only the fluid surrounding either cylinder provides any sort of crude shock absorbance. In U.S. Pat. No. 5,730,692 specifically designed rolls themselves function as vibration dampers due to the internal movement of pressurised liquids to absorb shock. In SU570421 pulsating fluid is fed along lines to induce forced vibrations of working rolls which at the correct amplitude and frequency can oppose and cushion the vibration of these rolls in use.

Physical damping units are also known for external positioning on the mill frame. In JP08247211 and in JP05104117 an amplitude sensor detects the vibration frequency of a rolling mill and a "chatter absorber" fitted externally to the mill frame itself is activated to counter this chatter.

In U.S. Pat. No. 5,724,846 there is proposed a method whereby a low power vibration component that is non-synchronous is introduced into the mill frame which prevents the rolls from vertically oscillating in any generally large, uncontrollable manner. It is not made clear as to why this system would prevent chatter from occurring and the approach has not been widely used in practice.

In U.S. Pat. No. 5,512,009 a method and apparatus is provided comprising an oscillation-inducing device which is coupled to the roller for inducing an axial oscillation in the roller being of substantially greater frequency than the frequency of rotation of the roller. This method pertains to reducing a specific form of chatter, "optical chatter". Although evidence suggests that this form of chatter is associated with axial oscillations in a grinding mill, it has not yet been demonstrated to be relevant to rolling mills.

SUMMARY OF THE INVENTION

In a first aspect the present invention provides vibration damping apparatus for use in a rolling mill, the apparatus including:

a body positionable for sliding movement in an enclosure located at or near a roll chock of the mill; and damping means integral with the body for providing vibration damping of roll chock(s) within the mill.

By having the damping means integral with the body, the apparatus can replace existing conventional apparatus used to apply forces to the roll stack of a rolling mill and yet still operate so that the occurrence of chatter vibration induces motion within the body which is resisted by damping means which act to dissipate the vibration energy.

Preferably the damping means is a compartment located at one end of the body, the compartment including one or more vibration absorbing components. Preferably the compartment is located at an end of the body outside of the enclosure to abut with one of the roll chocks. Whilst the damping means may be compartmentalised (or part of an enclosure), individual unenclosed damping elements can also be employed such as springs, pads etc mounted at the end of the body. The damping means may also be arranged intermediate the ends of the body.

Preferably an opposing end of the body is located within the enclosure and is in contact with a fluid therewithin, the fluid moveable into or from the enclosure via a passage (eg a tube) ultimately connected to a reservoir, in use to transmit force to the body in the enclosure.

Preferably a second vibration absorbent compartment portion of the body, including further vibration absorbing components, is located at the opposing end of the body and in contact with the fluid.

In an alternative or additional arrangement the second vibration absorbent compartment can solely or additionally define the damping means.

Preferably the enclosure is defined within one of the roll chocks or as part of separate apparatus positionable between opposing roll chocks.

Preferably the apparatus is mounted at a lower of the opposing chocks and an in use uppermost end of the body contacts the underside of an upper of the opposing roll chocks.

Preferably the body is a cylindrically shaped piston.

Preferably the compartment(s) of the body include one or more vibration absorbing components including spring(s) and/or vibration absorbing pad(s). In an alternative arrangement, the second vibration absorbent compartment of the body can include one or more vibration absorbing components including a spring, air etc.

In a further aspect the present invention provides vibration damping apparatus for use in a rolling mill, the apparatus including:

a body positionable for sliding movement in an enclosure located at or near a roll chock of the mill; and damping means comprising a fluid located within the enclosure and in communication with the body, the fluid being moveable into or from the enclosure such that the fluid movement is responsive to detected vibration to provide for vibration damping of roll chock(s) within the mill.

In a further aspect the present invention provides a method for damping vibration in a rolling mill including the steps of:

(i) positioning a slidable body and associated damping means at or near a roll chock of the mill; and (ii) regulating the damping means in a manner that provides a counteractive damping to vibration characteristics of the rolling mill.

Preferably the damping means includes springs and/or vibration absorbing pads positionable with respect to the body and step (ii) includes selecting spring and/or pad vibration absorbing characteristics which counteract the vibration characteristics of the rolling mill; or the damping means includes a fluid positionable with respect to the body and step (ii) includes selecting fluid characteristics that counteract the vibration characteristics of the rolling mill.

Preferably the characteristics of the spring and/or pad which are varied include geometry, elastic modulus and damping material constant, and in the case of a fluid, the viscosity and the elastic modulus of the fluid.

BRIEF DESCRIPTION OF THE DRAWINGS

Notwithstanding any other forms which may fall within the scope of the present invention, prefered forms of the invention will now be described, by way of example only, with reference to the accompanying drawings in which.

MODES FOR CARRYING OUT THE INVENTION

Figure 1:
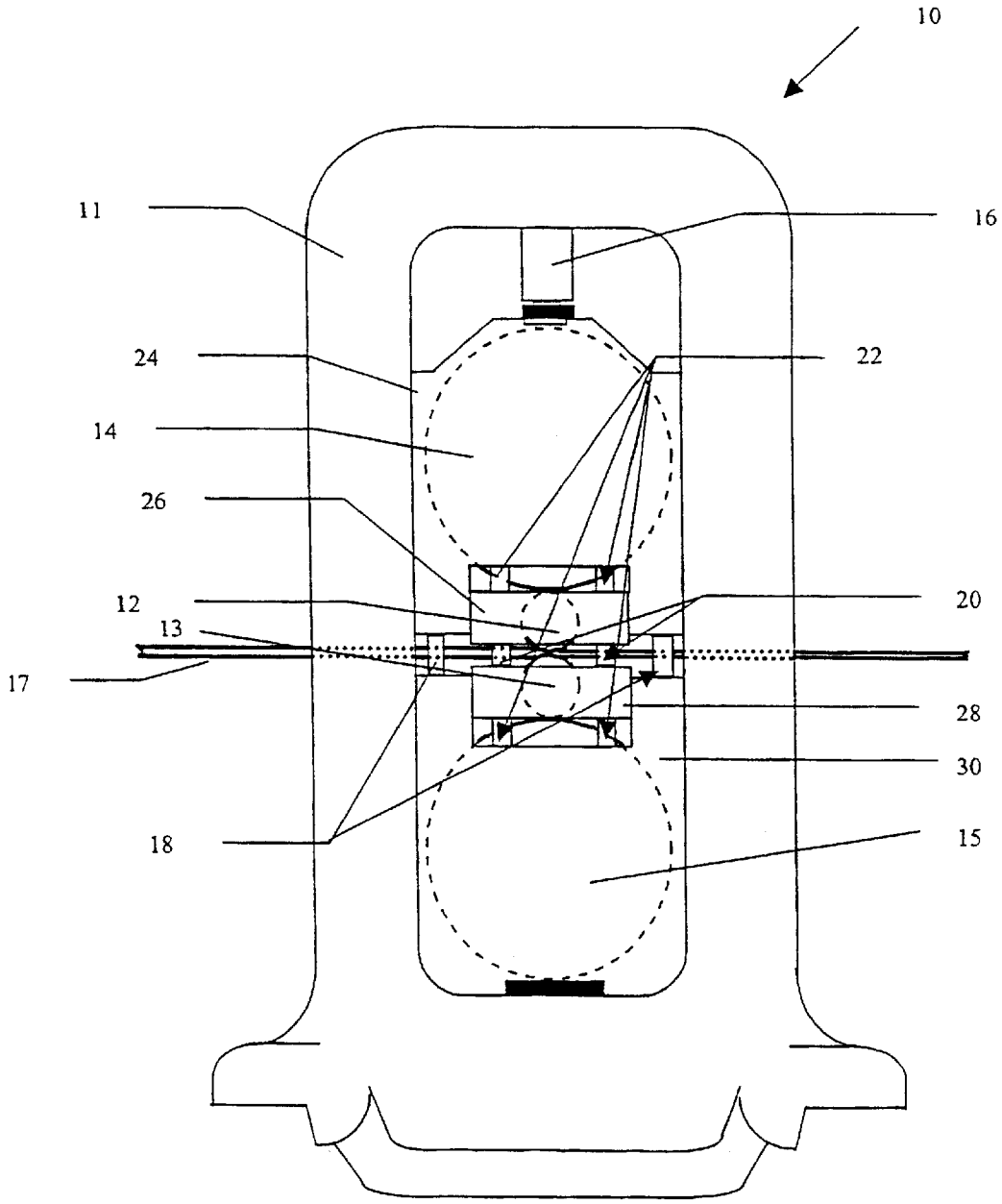
FIG. 1 is a crossectional schematic illustration of a prior art rolling mill having hydraulically actuated pistons to perform functions associated with rolling a strip of material.

Referring to the drawings, the present invention will be better understood in the context of the following description of the rolling process and related actuators in the roll stack 10. In FIG. 1 the work rolls 12, 13, which are mounted respectively in chocks 26, 28 located in mill frame 11, perform a thickness reduction by deforming a material (typically metal) strip 17 plastically as it passes between them. Backup rolls 14, 15, which are mounted respectively in chocks 24, 30, primarily provide vertical support and minimise deflection for the respective work rolls 12, 13. Also in the roll stack 10 are a number of hydraulically actuated pistons which apply forces to components of the roll stack 10 for several purposes, the primary purposes being:

(a) Main roll force pistons 16 for compressing the strip;

(b) Backup roll balance pistons 18 used to support and lift the backup roll chock 24 to allow the work rolls to be removed during a roll change;

(c) Work roll balance pistons 20 to ensure that the top work roll 12 is in contact with the upper backup roll 14; and (d) Work roll bending pistons 22 to apply bending to the work rolls 12, 13 for flatness and thickness profile control.

It should be noted that the form of roll stack 10 may vary from the example described in FIG. 1 and may incorporate other actuated pistons. The following description of a preferred embodiment of the invention relates to the backup roll balance pistons 18. However, it is important to note that the scope of the present invention also includes any other actuated piston present in any form of roll stack or that is subsequently added.

The present invention preferably provides a specialised piston which can be used in a primary function of applying force, but also to reduce the occurrence of chatter in the roll stack, or solely for the reduction of chatter.

Figure 2:
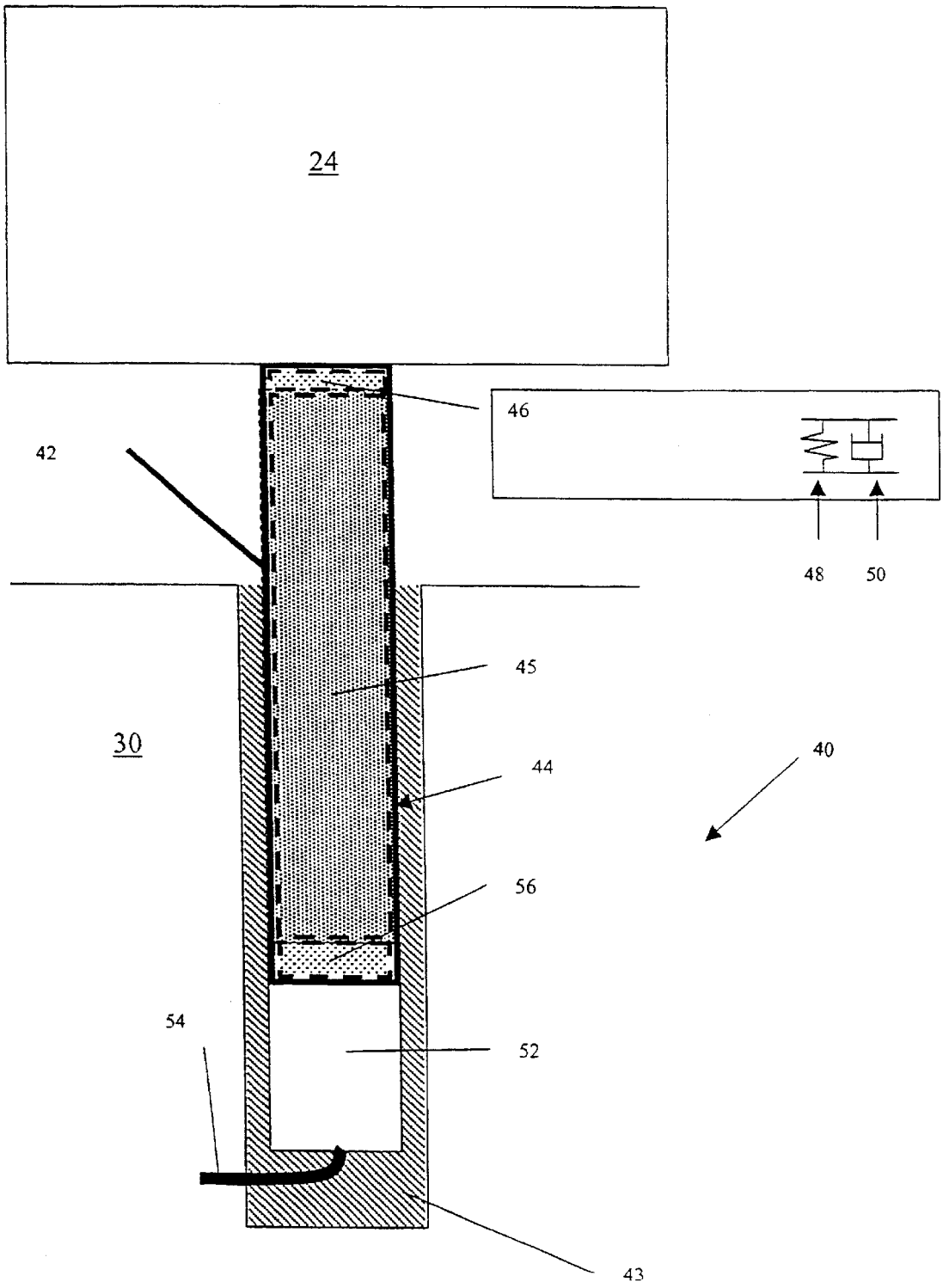
FIG. 2 is a crossectional schematic illustration of one embodiment of a vibration damping apparatus in accordance with the invention.
Figure 3:
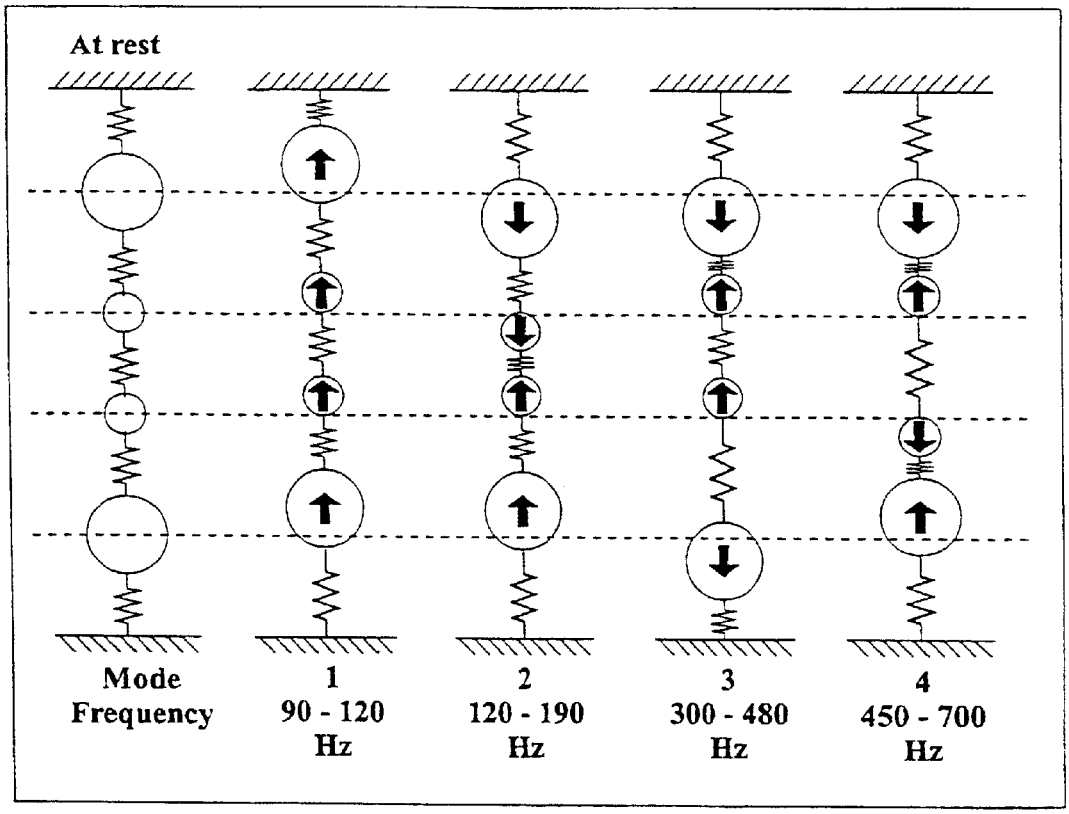
FIG. 3 shows four possible vertical vibration modes in a prior art four high roll stack, involving only the work rolls and backup rolls, together with typical frequency ranges for each mode. Mode 2 describes the relative motion of the rolls during third octave chatter.

Referring to FIG. 2, vibration damping apparatus 40 is shown for use in a rolling mill stack 10. The apparatus includes a body in the form of backup roll balance piston 42 positionable for sliding movement in an enclosure in the form of cavity 44 defined (in this embodiment) in the lower backup roll chock 30 of the mill stack 10. However the piston could be provided in a separate housing which is then mounted on/to the roll stack. The piston 42 moves within a cavity lining 43 which prescribes the direction of piston movement. Ideally the axis of the piston 42 is aligned with the direction of vibration of the body it is in contact with. The body of the piston is a casing which performs the role of a conventional piston by transmitting static load, which also has internal damping features. Piston 42 includes a solid mass component 45 which is generally cylindrically shaped and of any suitable crossection. The piston mass 45 is typically made of dense material, for example a metal such as tungsten or lead, thus having a high piston mass for the allowable volume of cavity in the lower backup roll chock. The mass 45 can move freely within the piston 42 in the direction of vibration, with a small annular gap present between the outer wall of mass 45 and the inner wall of piston 42. In order to further increase the weight of mass 45 and in use to improve the damping performance of piston 42, a collar or other lateral extension piece may be added to the upper region of mass 45 in that portion of piston 42 which protrudes from cavity 44.

FIG. 2 also shows damping means integral with the piston 42 for providing vibration damping of opposing backup roll chocks 24, 30 in use. The damping means is a specially designed absorption system to provide tuned stiffness and damping elements which act in parallel and are located in compartment 46 at an uppermost end or cap of the piston 42, in use abutting with the underside of the opposing upper backup roll chock 24. The compartment 46 includes one or more vibration absorbing components such as a spring 48 to provide stiffness (depending upon the mass and stiffness of the spring) and/or vibration absorption pad 50 (for example rubber which provides the energy absorption). Alternatively the compartment 46 can be filled with a fluid of known properties to function in a similar fashion. By forming the compartment integrally with the piston the damping capacity of the apparatus is enhanced. The apparatus is unitary and thus inherently more stable.

An opposing end of the piston 42 is located within the cavity 44 and is in contact with a pressurised hydraulic fluid 52 which itself moves into or from the cavity 44 via a tube 54 ultimately connected to a reservoir (not shown). The piston 42 transmits force between the pressurised hydraulic fluid 52 at one end and the body it is in contact with at the other (upper) end.

A second vibration absorbent compartment portion 56 of the piston 42 is typically provided and also includes vibration absorbing components. Portion 56 is typically an integral cap located at the end of the piston 42 in contact with the fluid 52. This component 56 acts as an isolation system to isolate the piston mass and damping components from the variable fluid dynamic properties of the hydraulic fluid 52 such as the temperature dependence of fluid viscosity, for example. The isolating system consists primarily of a low stiffness element such as a spring with zero stiffness and/or an air cavity. The stiffness of this system is typically small when compared to the equivalent stiffness of the vibration damping compartment 46.

In an alternative arrangement the second vibration absorbent compartment 56 can solely define the damping means in a situation where the piston 42 may not be in direct contact with the upper backup roll chock 24. In such a situation the compartment 56 can include one or more vibration absorbing components such as spring 48 and/or vibration absorption pad 50 or a fluid substance.

Although it is preferred that the enclosure is defined within one of the roll chocks as illustrated in FIG. 2 (typically the lower of the roll chocks), it may also be provided in a separate apparatus positionable between the roll chocks.

The components of the vibration damping apparatus 40 typically have the following functions in regards to suppressing chatter vibration:

- the absorption system in compartment 46 provides appropriate stiffness and damping components;
- the piston 42 is designed to have a sufficient mass 45 component; and
- the isolating end cap compartment 56 is designed to have a very low stiffness to isolate the properties of the hydraulic fluid from the dynamic behavior of the piston system.

The components of the vibration damping apparatus are designed and constructed so that the system has the optimum mass, stiffness and damping to provide maximum dissipation of chatter vibration at a particular frequency. The mass of the piston is made as large as possible to maximise the inertial effects of the damper apparatus on the rolling mill system. The stiffness of the absorption system is tuned to closely match the motion of the piston to the chatter vibration frequencies and the damping is tuned to maximise energy dissipation. Optimisation of tuning frequency and damping ratio can maximise the rolling speed attainable before chatter first begins to occur. The optimal tuning frequency and damping are both determined by the ratio of the mass of the damper to the effective mass of the chattering mill system.

In operation the piston 42 performs the functions of suppressing chatter vibration as well as performing its prior art conventional function of an actuated piston as described above. The piston of the present invention can replace existing conventional pistons of rolling mill actuators with relative ease during a typical roll change stage with minimal interruption to production. The pistons are designed such that the occurrence of chatter vibrations induces motion within the piston. This motion within the piston is resisted by damping elements which act to dissipate the vibration energy. The arrangement of the piston is such that it is tuned to react with maximum effect to vibrations occurring close to the characteristic chatter frequency. The piston is thus effective in stopping the accumulation of vibration energy in the roll stack which occurs during chatter. As the piston system is tuned to respond at the frequency of chatter, it does not affect the ability to control the thickness of the rolled strip which occurs at a much lower frequency.

In another possible embodiment, the vibration damping compartment 46 can contain a material with a stiffness that varies with static load applied to it, for example a fluid or a spring. In such an embodiment the stiffness may be tuned by adjusting the static load applied by the hydraulic fluid. Further, the vibration damping can in fact be provided by the hydraulic fluid 52 where the fluid is selected with suitable vicosity, elastic modulus and damping characteristics. In such an example system, a vibration sensor can be connected to a feedback control unit to adjust the volume of fluid in the cavity below the position of the piston 42.

In yet another possible embodiment of the invention, the piston may be housed in a cavity in the chock itself without transmitting a static load to another body, for example, an opposing roll chock. In such an embodiment the piston may be housed on the upper side of backup roll chock 24, for example, and the resulting motion within the piston is resisted by the damping elements which act to dissipate the vibration energy.

The present invention, in one particular embodiment, is directed primarily towards reducing the occurrence of third and fifth octave chatter vibrations of the roll stack during the process of rolling, but it is to be appreciated that the invention is not necessarily restricted to the suppression of these types of chatter.

It is to be understood that various alterations, modifications and/or additions may be made to the features of the embodiments of the invention as herein described without departing from the spirit and scope of the invention.

What is claimed is:

1. Vibration damping apparatus for damping vibration of a roll chock in a rolling mill, the apparatus including:

a body connectable to the roll chock and slidable in an enclosure located at or near the roll chock in response to relative movement between the roll chock and the enclosure; and damping means integral and moveable with the body, the damping means positioned for providing vibration damping of the roll chock and comprising a compartment located at one end of the body outside of the enclosure to abut with the roll chock, the compartment including one or more vibration absorbing components.

2. Vibration damping apparatus as claimed in claim 1 wherein an opposing end of the body is located within the enclosure and is in contact with a fluid therewithin, the fluid moveable into or from the enclosure via a passage ultimately connected to a reservoir, in use to transmit force to the body in the enclosure.

3. Vibration damping apparatus as claimed in claim 2 wherein a second vibration absorbent compartment portion of the body, including further vibration absorbing components, is located at the opposing end of the body and in contact with the fluid.

4. Vibration damping apparatus as claimed in claim 1 wherein the enclosure is defined within a further roll chock or as part of separate apparatus positionable between opposing roll chocks.

5. Vibration damping apparatus as claimed in claim 4 wherein the apparatus is mounted at a lower of the opposing chocks and an in use uppermost end of the body contacts the underside of an upper of the opposing roll chocks.

6. Vibration damping apparatus as claimed in claim 1 wherein the body is a cylindrically shaped piston.

7. Vibration damping apparatus as claimed in claim 3 wherein the second vibration absorbent compartment of the body includes one or more vibration absorbing components including at least one of a spring, a vibration absorbing pad or a vibration absorbing fluid substance.

8. A method for damping vibration of a roll chock in a rolling mill including the steps of:

(i) positioning a slidable body and associated damping means as defined in claim 1 at or near a roll chock of the mill; and (ii) regulating the damping means in a manner that provides a counteractive damping of vibration characteristics in the rolling mill.

9. A method as claimed in claim 8 wherein the damping means includes at least one of a spring and a vibration absorbing pad positionable with respect to the body and step (ii) includes selecting vibration absorbing characteristics of at least one of the spring and the pad which counteract the vibration characteristics of the rolling mill; or the damping means includes a vibration absorbing fluid positionable with respect to the body and step (ii) includes selecting fluid characteristics that counteract the vibration characteristics of the rolling mill.

10. A method as claimed in claim 9 wherein the characteristics of the spring or pad which are varied include geometry, elastic modulus and damping material constant, and in the case of a fluid, the viscosity and the elastic modulus of the fluid.

11. Apparatus for transmitting force between a roll chock and another part of a rolling mill, the apparatus including:

a body slidable in an enclosure, the body being connectable to one of either the roll chock and the another part of the rolling mill, and the enclosure being located at the other of the roll chock and the another part of the rolling mill, wherein the body is capable of transmitting force to and from the roll chock; and damping means integral and moveable with the body and for providing vibration damping of the roll chock within the mill, wherein the damping means comprises a compartment located at one end of the body, the compartment including one or more vibration absorbing components which comprise at least one of a spring, a vibration absorbing pad, or a vibration absorbing fluid substance.

12. A method for transmitting force between a roll chock and another part of a rolling mill including the steps of:

positioning, the apparatus of claim 11 between the roll chock and the another part of the mill, the body of the apparatus being arranged to transmit force therebetween; and regulating the damping means by selecting vibration absorbing characteristics of at least one of the spring, the pad or the fluid substance, which counteract the vibration characteristics of the rolling mill.

13. Apparatus for transmitting force as claimed in claim 11 wherein the another part of the rolling mill is one of a roll chock or a rolling mill frame.

14. Vibration damping apparatus as claimed in claim 11 wherein the damping fluid is selected based on its properties of viscosity and elastic modulus.

15. Vibration damping apparatus as claimed in claim 11 wherein the body also includes an internal element of a dense mass material.

16. Vibration damping apparatus as claimed in claim 15 wherein the internal element is moveable within the body, the movement restricted by the vibration damping component.

17. Vibration damping apparatus for damping vibration of a roll chock in a rolling mill, the apparatus including:

a body connectable to the roll chock and slidable in an enclosure located at or near the roll chock in response to relative movement between the roll chock and the enclosure, the body having first damping means integral and moveable therewith, the damping means positioned for providing vibration damping of the roll chock, the damping means comprising a compartment located at one end of the body and including one or more vibration absorbing components which comprise at least one of a spring, a vibration absorbing pad or a vibration absorbing fluid substance, and second damping means comprising a fluid located within the enclosure and in communication with the body, the fluid being moveable into or from the enclosure such that the fluid movement is responsive to detected vibration to provide for further vibration damping of the roll chock within the mill.

18. A method for damping vibration of a roll chock in a rolling mill including the steps of:

(i) positioning a slidable body and associated damping means as defined in claim 17 at or near a roll chock of the mill; and (ii) regulating the damping means in a manner that provides a counteractive damping of vibration characteristics in the rolling mill.

19. A method as claimed in claim 18 wherein step (ii) includes selecting characteristics of the fluid of the second damping means to counteract the vibration characteristics of the rolling mill.

20. A method as claimed in claim 19 wherein the characteristics of the fluid which are varied include the viscosity and the elastic modulus of the fluid.

21. Vibration damping apparatus for damping vibration of a roll chock in a rolling mill, the apparatus including:

a body connectable to the roll chock and slidable in an enclosure located at or near the roll chock in response to relative movement between the roll chock and the enclosure; and damping means integral and moveable with the body, the damping means positioned for providing vibration damping of the roll chock, the damping means comprising a compartment located at one end of the body and including one or more vibration absorbing components which comprise at least one of a spring and a vibration absorbing pad, or a vibration absorbing fluid substance.

22. Vibration damping apparatus as claimed in claim 21 wherein the compartment is located at end of the body outside of the enclosure to abut with the roll chock.

23. Vibration damping apparatus as claimed in claim 22 wherein an opposing end of the body is located within the enclosure and is in contact with a fluid therewithin, the fluid moveable into or from the enclosure via a passage ultimately connected to a reservoir, in use to transmit force to the body in the enclosure.

24. Vibration damping apparatus as claimed in claim 23 wherein a second vibration absorbent compartment portion of the body, including further vibration absorbing components, is located at the opposing end of the body and in contact with the fluid.

25. Vibration damping apparatus as claimed in claim 21 wherein the enclosure is defined within a further roll chock or as part of separate apparatus positionable between opposing roll chocks.

26. Vibration damping apparatus as claimed in claim 25 wherein the apparatus is mounted at a lower of the opposing chocks and an in use uppermost end of the body contacts the underside of an upper of the opposing roll chocks.

27. Vibration damping apparatus as claimed in claim 21 wherein the body is a cylindrically shaped piston.

28. Vibration damping apparatus as claimed in claim 24 wherein the second vibration absorbent compartment of the body includes one or more vibration absorbing components including at least one of a spring and a vibration absorbing pad, or a vibration absorbing fluid substance.

29. Vibration damping apparatus as claimed in claim 21 wherein the body also includes an internal element of a dense mass material.

30. A method for damping vibration of a roll chock in a rolling mill including the steps of:

(i) positioning a slidable body and associated damping means as defined in claim 21 at or near a roll chock of the mill; and (ii) regulating the damping means by selecting vibration absorbing characteristics of at least one of the spring and the pad, or of the fluid substance, which counteract the vibration characteristics of the rolling mill.

31. A method as claimed in claim 30 wherein the selected characteristics of the spring or pad include one or more of geometry, elastic modulus and damping material constant.

* * * * *